US012339086B2

(12) United States Patent
Craig

(10) Patent No.: US 12,339,086 B2
(45) Date of Patent: Jun. 24, 2025

(54) HYDRAULIC DAMPENED HIGH MASS ROTARY BARREL RECOIL SYSTEM FOR HANDGUN

(71) Applicant: Frederick Edmond Craig, Hutchinson, KS (US)

(72) Inventor: Frederick Edmond Craig, Hutchinson, KS (US)

( * ) Notice: Subject to any disclaimer, the term of this patent is extended or adjusted under 35 U.S.C. 154(b) by 0 days.

(21) Appl. No.: 18/401,215

(22) Filed: Dec. 29, 2023

(65) Prior Publication Data

US 2024/0263899 A1 Aug. 8, 2024

Related U.S. Application Data

(60) Provisional application No. 63/483,751, filed on Feb. 7, 2023.

(51) Int. Cl.
*F41A 5/06* (2006.01)

(52) U.S. Cl.
CPC ..... *F41A 5/06* (2013.01)

(58) Field of Classification Search
CPC ..... F41A 5/06; F41A 3/08; F41A 3/16
See application file for complete search history.

(56) References Cited

U.S. PATENT DOCUMENTS

| | | | | |
|---|---|---|---|---|
| 1,382,197 | A * | 6/1921 | Jolidon | F41A 5/06 89/196 |
| 1,744,162 | A * | 1/1930 | Hatcher | F41A 5/06 89/170 |
| 8,752,474 | B2 * | 6/2014 | Vanek | F41A 5/06 89/198 |
| 10,018,433 | B2 * | 7/2018 | Tuason | F41A 3/46 |
| 10,203,173 | B2 * | 2/2019 | Ellis | F41A 5/02 |
| 12,007,191 | B1 * | 6/2024 | Kellgren | F41A 3/66 |
| 2017/0211901 | A1 * | 7/2017 | Keller | F41A 3/66 |
| 2019/0242669 | A1 * | 8/2019 | Agnelli, Jr. | F41A 11/00 |
| 2024/0133653 | A1 * | 4/2024 | Dawson | F41A 3/66 |

FOREIGN PATENT DOCUMENTS

| | | | | |
|---|---|---|---|---|
| FR | 363873 | A * | 3/1906 | F41A 5/06 |

* cited by examiner

*Primary Examiner* — Derrick R Morgan
(74) *Attorney, Agent, or Firm* — Intellectual Property Consulting, LLC; Adam V. Vickers

(57) ABSTRACT

A hydraulically dampened rotary barrel locking system for a handgun is provided which preferably includes a receiver, a barrel and a spring-loaded moveable slide. The barrel comprises one or more axially aligned locking lugs configured to allow the slide to travel down the barrel axis when the lugs align with a keyway slot in an extended lug boss at the discharge end of the slide. Felt recoil is reduced and accuracy is improved due to a more balanced slide-to-barrel mass ratio than prior art and hydraulic dampening between the barrel and slide due to improved journal bearing action.

18 Claims, 13 Drawing Sheets

HYDRAULIC DAMPENED HIGH MASS ROTARY BARREL RECOIL SYSTEM FOR HANDGUN

RELATED APPLICATIONS

This application claims priority to U.S. Provisional Application No. 63/483,751 filed Feb. 7, 2023. The entire contents of the above application are hereby incorporated by reference as though fully set forth herein.

FIELD OF THE INVENTION

The present invention relates to the field of firearms. More specifically, the present invention relates to a rotary locking barrel system for a handgun, which is hydraulically dampened with above average barrel mass to promote greater accuracy, durability, and superior recoil management as compared to the prior art.

BACKGROUND

Since the early 1900's, handgun development has manifested a plethora of unique methods for controlling the energy from high pressure ammunition cartridges. With the advent of the 9 mm Luger cartridge by Georg Luger in 1901 and John Browning's 45 ACP cartridge in 1904, and their subsequent rapid popularity as formidable military auto loading cartridges, firearms developers in Europe and the United States scrambled to design handguns capable of handling this new high-energy ammunition.

John Browning designed a tilting locked barrel which was durable and very effective in keeping the barrel locked to the slide. His design also allowed for a very good ratio of slide mass to barrel mass, which made his handgun sleek and less bulky than virtually all other pistols of that era and well beyond. Also, Browning's pistol offered a fairly low-bore axis which offered much better recoil control characteristics than virtually any handgun made for the next 100 years. What is truly amazing is that he was also able to accomplish this chambering a much larger and powerful cartridge, and thus the genius of his design is still relevant to this day. Now, 120 years later, Browning's tilting lock system is the standard for most semi-automatic center fire handguns.

George Luger chose a very different path in his delayed blowback design. He created what is called a toggle type lockup. This was actually more of an inertia-based arrangement than a true locked breech. Nevertheless, his design proved to be a reliable platform for his smaller but higher pressure 9 mm cartridge. The design was bulky though and very complicated to manufacture. But more important is Luger's contribution of the 9 mm cartridge. This cartridge went on to become the paragon in small arms ammunition. It has become the standard NATO military round and the basis for which most combat handguns are designed and tested.

Other inventors imagined an advantage in creating what is called a rotary locking mechanism. This mechanism features a round barrel that rotates within the slide and frame, moving parallel with the movement of the slide. The idea was that a barrel which remained on its axis under recoil would improve accuracy and be more reliable in both feeding and extracting ammunition.

An early example of a rotary locking pistol was the Austrian made Steyr Hahn from the First World War, which would become the basis for rotary locking designs for the next century. The barrel of the Steyr design had two main locking lugs that locked into the barrel tunnel via slots cut on the inside of the slide. A lug on the bottom of the barrel matched a radial cut cam groove in the frame of the pistol which rotated the barrel as the slide and barrel move rearward under recoil. The Hahn was difficult to manufacture and did not stand out among other sidearms of the time. Therefore, its life would be short lived.

Throughout the twentieth century, many firearms developers attempted to repackage the rotary barrel design into a commercial success. A few varieties made it on the market for a while, but these smaller guns were based more on the Savage design from the early 1900's, which was an inertia based radial delay, not a true rotary locked system. They also generally fired smaller less powerful cartridges like 32acp and 380acp. MAB of Italy made several models including a 9 mm version in the PA-15, which was also a radially delayed mechanism, and not a true locked breech design.

Later in the 20th century, a few attempts were made to make a modern version of the Rotary pistol that could fire the more powerful cartridges like 9 mm Luger, 40 S&W, and even 45acp. In 2008 Grand Power of Slovakia introduced a unique Rotary locked pistol as the K100. This pistol, though having some beneficial features over its predecessors, it still remained bulky and lacking in barrel mass.

In 1994 Beretta released the Cougar model. This was a true rotary locking pistol much like those of the past but packaged in a more conventional format. Since the vast majority of semi-auto service type handguns in the late 1900's utilized some form of Browning's tilting lockup, Beretta's choice to rekindle the rotary locking design was more to set themselves apart in the marketplace than to try and outperform the competition. This was evident because the Cougar, like its predecessors, was bulky and lacked any perceived advantage in performance. Although it was not a great commercial success and was undoubtedly expensive to produce, in 2004 Beretta came out with a polymer framed version of the pistol to make it more cost effective; it remains part of Beretta's product line today.

The latest rotary locking design came from Glock of Austria in 2018. This pistol, though not seeing actual production for the civilian market, incorporates a unique rotary system with a rotating breech. The Glock 46 suffers from the same lack of barrel mass as its predecessors. This lack of barrel mass and increase in slide mass accentuates the recoil impulse of the handgun. Again, the shortcomings are due to the Glock 46's radially positioned barrel lugs, leaving the barrel body diameter much smaller than would be desired. Ultimately the Glock 46's barrel weight comes in noticeably lighter than the standard Glock 19 tilting locked cousin.

Looking back nearly 120 years through the lens of modern handgun design, every rotary locking delayed blow back system has failed to meet the expectations of their audience, as compared to Browning's tilting lock standard. This holds true because they all share the same common but flawed design feature; they have opposing locking lugs placed radially around the outside diameter of the barrel, which are engaged in lug recesses within the barrel tunnel of the slide. This common feature creates many issues.

First, to be durable these locking lugs must be of a certain height or thickness protruding from the barrel body diameter, which requires that the body diameter is reduced to a less desirable size to allow for enough material on the lugs. Also, this lug-barrel configuration demands a relatively wide and tall slide for the barrel locking lugs to have enough material to engage with. In essence, this configuration translates into a much thicker and larger slide than would be seen on a tilting lock design. The low barrel mass and high slide mass is the wrong direction for a design to go by today's standards. To soften recoil, barrel mass is essential, so ideally a rotary barrel needs increased barrel diameter to achieve the desired barrel weight. This is not possible with regards to the prior art, as making the barrel larger diameter makes the slide proportionately larger, which in turn exacerbates the original problem of the slide being too bulky and heavy.

Second, with the past rotary designs, the positioning of the locking lugs adds to the height of the slide. This creates a high bore axis and additional mass above the axis which also amplifies muzzle rise. This is evident with the late model Beretta PX4. One of the locking lugs is positioned vertically in the ejection port area, so additional material is necessary on the top of the slide to accommodate the height of the barrel lug. This makes for a very tall and bulky slide.

Third, accuracy has always been a theoretical advantage of a rotary barrel design. Unfortunately, this has never come to fruition. All rotary designs have failed to achieve better accuracy than their tilting lock cousins. This is mostly due to the nature of manufacturing a rotary design. Rotary locking barrel systems use a round barrel with radially positioned barrel lugs, riding in a round hole in the slide. These tolerances must be looser than what is ideal for there to be sufficient tolerance for the barrel and lugs to move freely along its axis from. And upon closing into battery position rotary locking systems have not found a good way to lockup in the full battery position as tilting lock systems have, so the potential for improved accuracy in a rotary locking system has not yet been realized.

Last, manufacturing a rotary locked system has proven to be complicated and costly. Current radial locking lug placement requires that there are related lugs and grooves cut in the slide to match. These lugs and grooves are difficult to machine, which requires intricate machining processes and tooling. The grooving of the barrel tunnel also destroys the surface contact area of the tunnel, rendering it significantly less effective as a bearing surface or contact race.

Accordingly, there is a need for a rotary locking delayed blowback system which balances the barrel-to-slide mass ratio that is cost-effective to manufacture and operates reliably to realize the increased accuracy for which the rotary lock system was conceived.

BRIEF SUMMARY OF THE INVENTION

The primary goal of the invention is to create a modern handgun with an advanced rotary locking barrel system with increased barrel mass, reduced slide mass and hydraulic dampening to deliver better recoil management, increased accuracy, and be more economical to manufacture.

The invention accomplishes this first by creating a new and unique area on the pistol slide outside of the barrel tunnel to relocate and reconfigure the radially positioned locking lugs utilized in the prior art. This new area on the slide is called the extended lug boss.

Additionally, the invention creates a series of new type barrel locking lugs disposed longitudinally along the barrel axis and which are axially aligned. The improved lug positioning allows the lugs to travel through the extended lug boss on a keyway slot. The axial locking lugs feature a reinforced primary lug called the control rail lug.

Consequently, the body of the slide no longer houses locking lugs for the barrel, the width and height of the slide is greatly reduced compared with prior art, thus lowering the bore axis. Also, the barrel tunnel of the slide is now free of machined grooves and lugs and can retain the contact surfaces necessary to achieve the invention's hydraulic damping feature. Also, barrel tunnel is larger than the prior art, which allows the barrel to have more mass than the prior art. This additional mass is used to help absorb the recoil energy created by the fired cartridge. These two new and novel accommodations deliver a felt recoil performance advantage in order of magnitude over the prior art.

Additionally, accuracy is improved over prior art because the barrel locking lugs, and corresponding slide lugs are no longer within the barrel tunnel of the slide. The barrel tunnel becomes a bearing journal and the barrel a bearing shaft, which is sized, fitted, and mated to the journal. Combined with the correct weight of lubricating oil, a surface film is formed on the journal which allows the rotary barrel to float and center within the tunnel of the slide, which improves the accuracy of the system significantly compared to the prior art.

Furthermore, the invention promotes a more cost-effective method to machine the locking lugs of the slide as compared to the prior art because the locking lugs are housed in the extended lug boss at the muzzle end of the slide. The locking lugs may easily be fixtured, accessed, reached, and cut with common equipment and tooling.

To summarize, the invention offers the benefits of better recoil management by increasing barrel mass, the benefit of hydraulic dampening, reduced slide mass and height, and lowered bore axis, thereby enhancing accuracy, increasing durability, and providing a more economical firearm to manufacture.

BRIEF DESCRIPTION OF THE DRAWINGS

FIG. 10 is a perspective view of the discharge end of one embodiment of the invention out of battery.

DETAILED DESCRIPTION OF THE INVENTION

Figure 1:
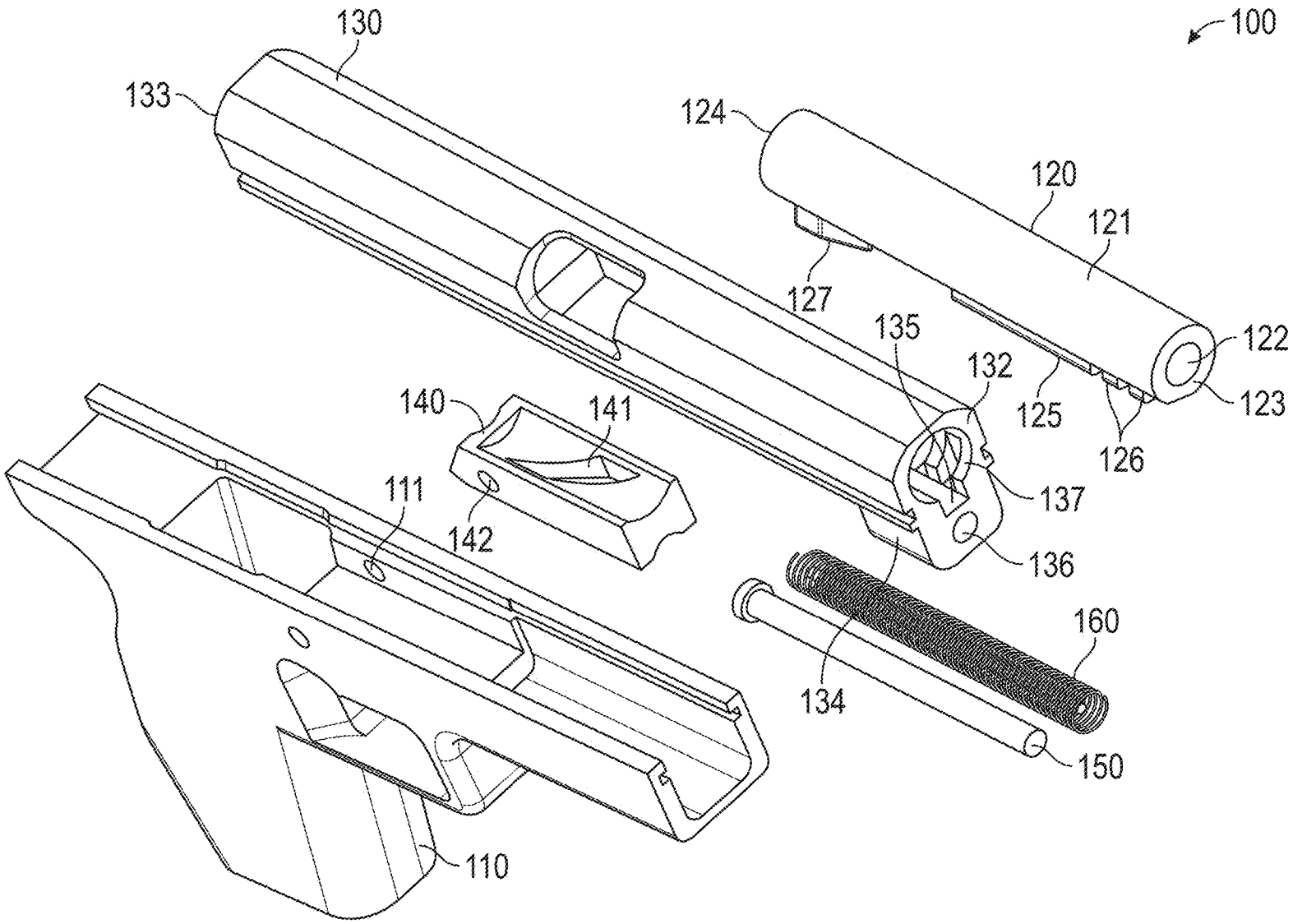
FIG. 1 is an exploded perspective view of one embodiment of the invention's primary components.
Figure 2:
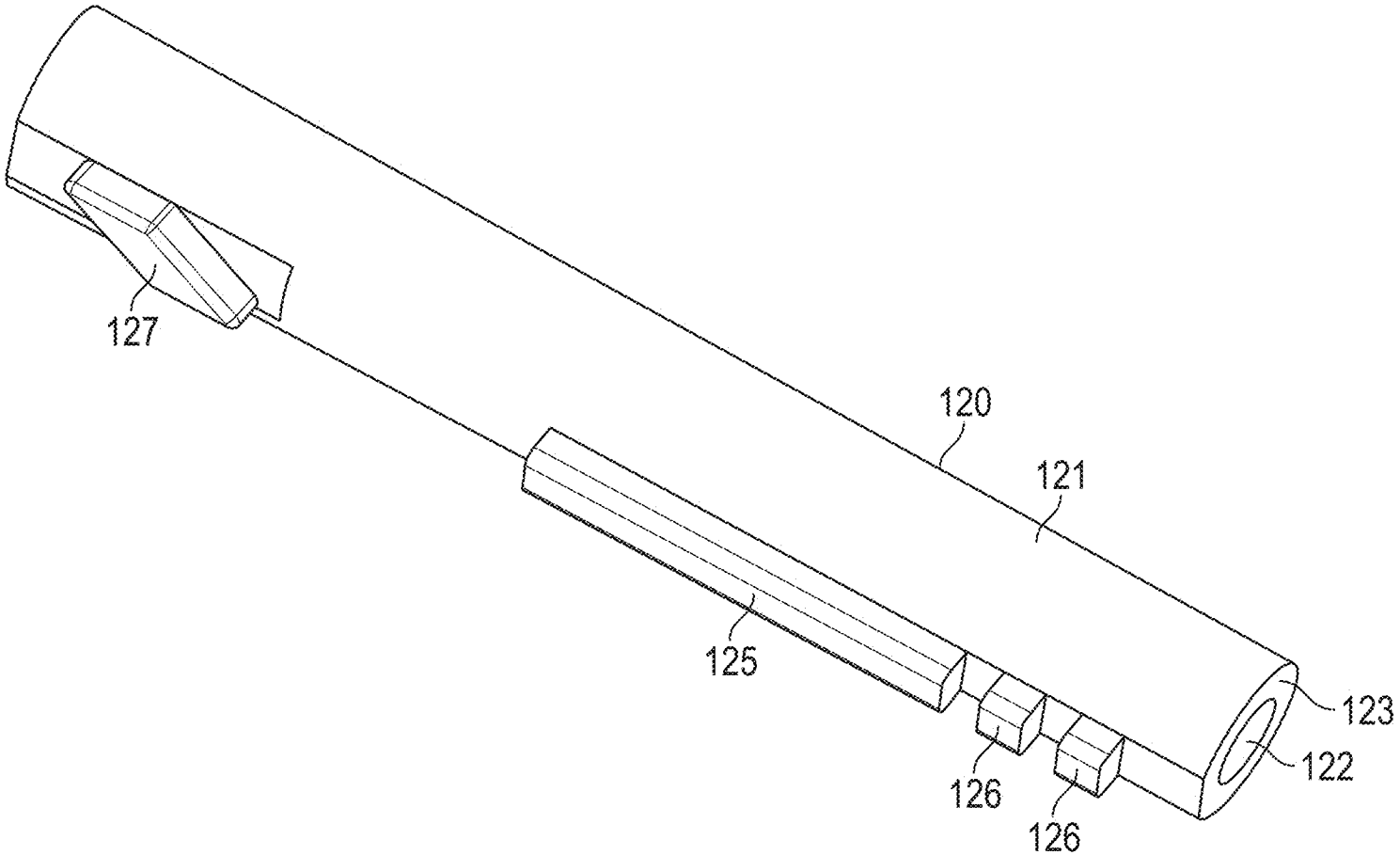
FIG. 2 is a perspective view of one embodiment of the barrel viewed from the side.

FIG. 1 shows one embodiment of an exploded view of firearm 100. For this embodiment, firearm 100 includes a pistol frame 110 with cross pin holes 111, a barrel 120, a slide 130, a cam block 140 with cam slot 141 and cross pin bore 142, a guide rod 150, and a recoil spring 160. Barrel 120 further comprises external surface 121, inner bore 122, barrel discharge end 123, barrel chamber end 124, and control rail lug 125. In another embodiment, barrel 120 may further comprise at least one barrel locking lug 126 and a cam lug 127. In such an embodiment, cam lug 127, control rail lug 125, and barrel locking lug 126 are configured such that they are axially aligned as depicted in FIG. 2. In alternate embodiments, the length of control rail lug is at least 0.25 inches and no longer than 4.0 inches.

Figure 3:
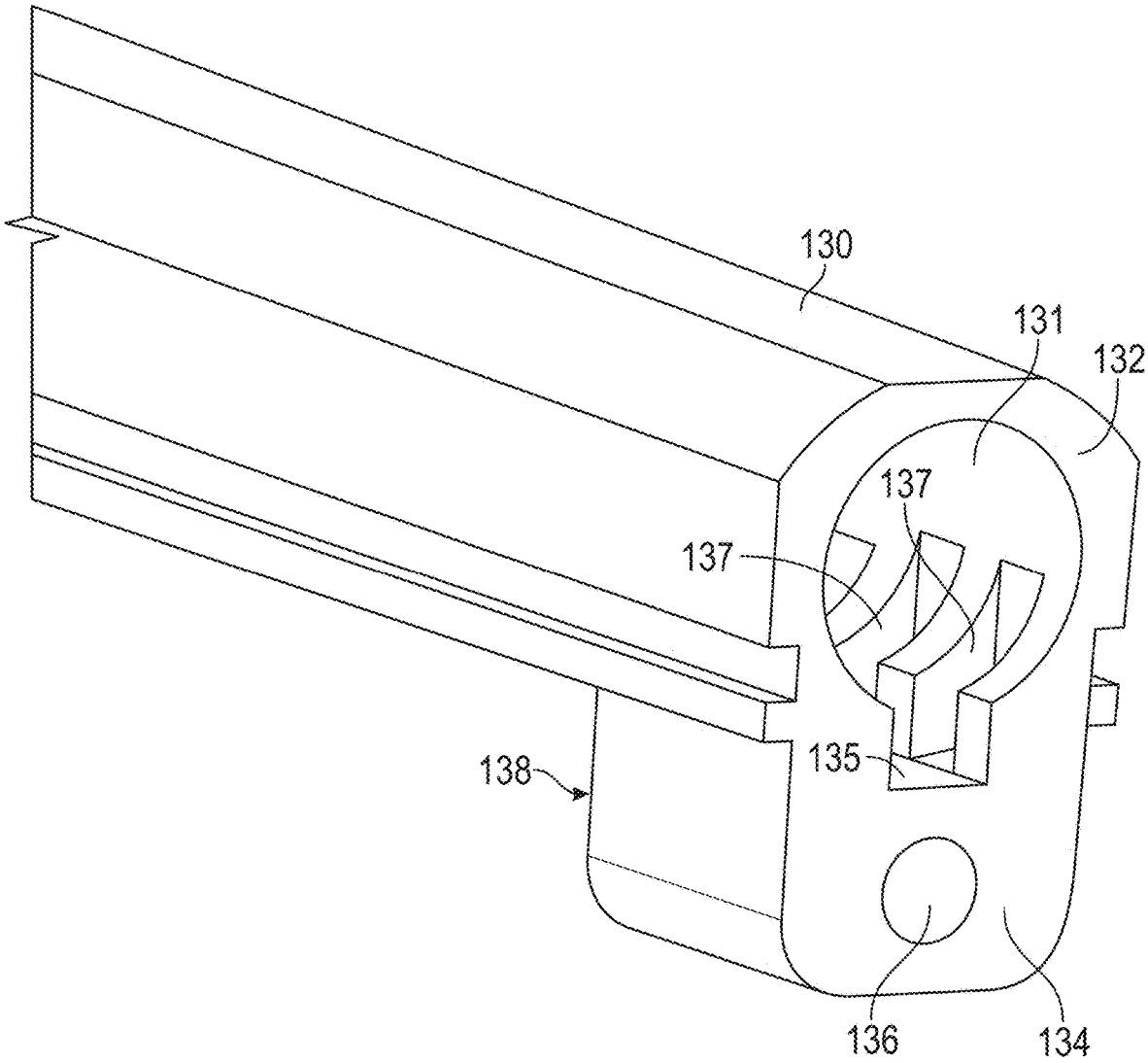
FIG. 3 is a perspective view of one embodiment of the discharge end of the slide.
Figure 11:
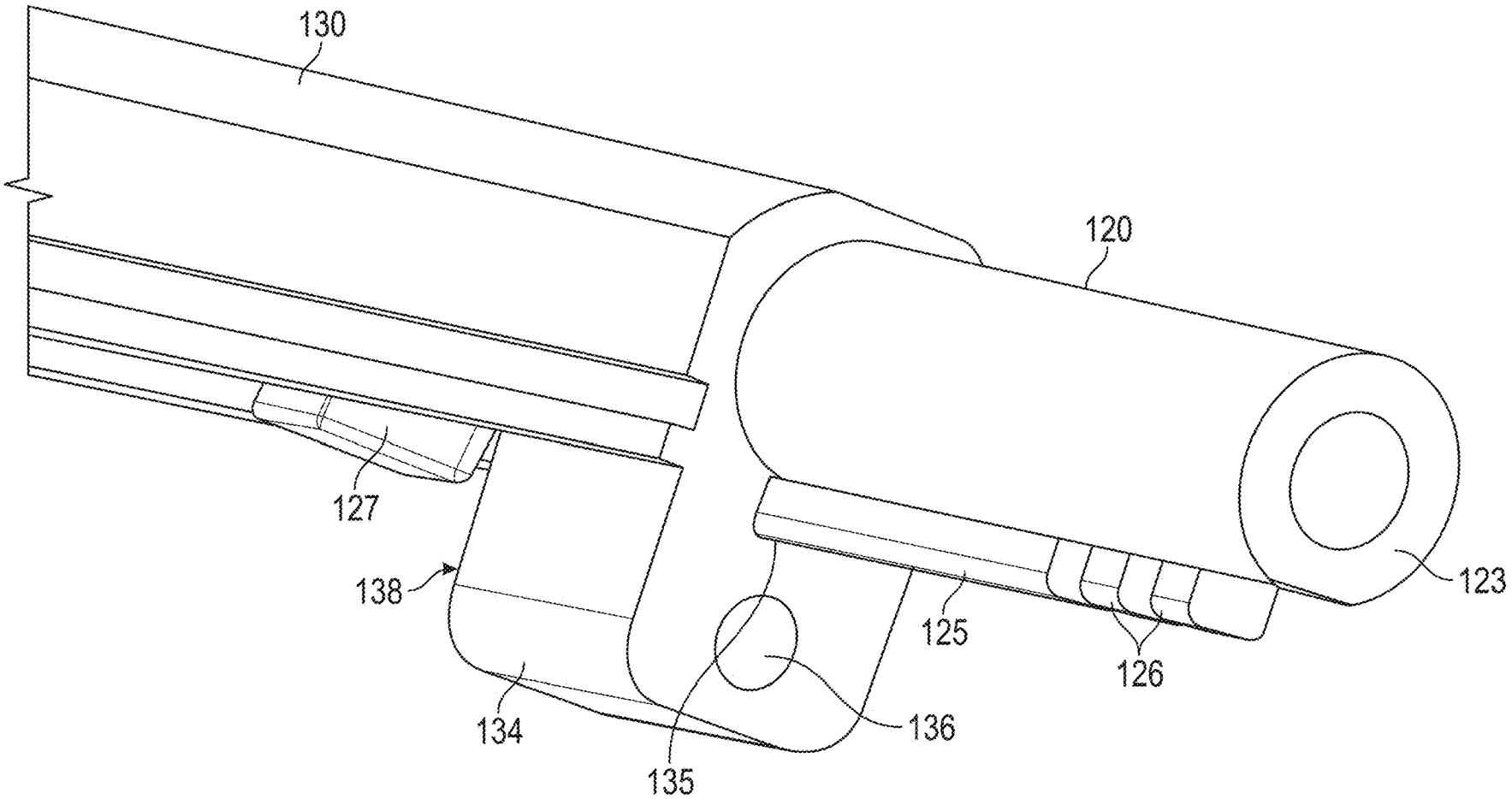
FIG. 11 is a perspective view of the discharge end of one embodiment of the invention out of battery.

As shown in FIG. 1 and FIG. 3 (magnified view), slide 130 further comprises slide bore 131, slide discharge end 132, slide rear end 133, extended lug boss 134, keyway slot 135, rod bore 136, and extended lug boss rear face 138 (the latter also shown in FIG. 11). In one embodiment, slide 130 may also comprise at least one slide locking slot 137 configured to receive barrel locking lug 126 when barrel 120 is inserted into slide bore 131 and rotated such that barrel locking lug 126 is aligned with slide locking slot 137. The operation of this feature is described more fully below.

Figure 4:
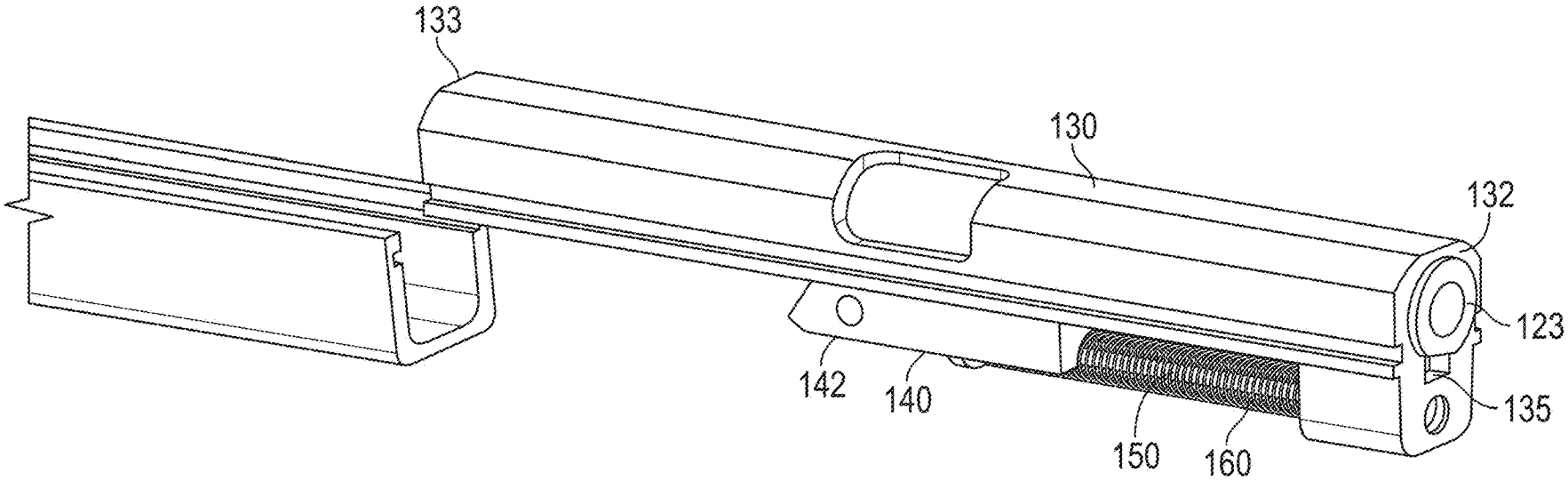
FIG. 4 is a perspective view of one embodiment of the upper assembly of the invention in the full battery position.
Figure 5:
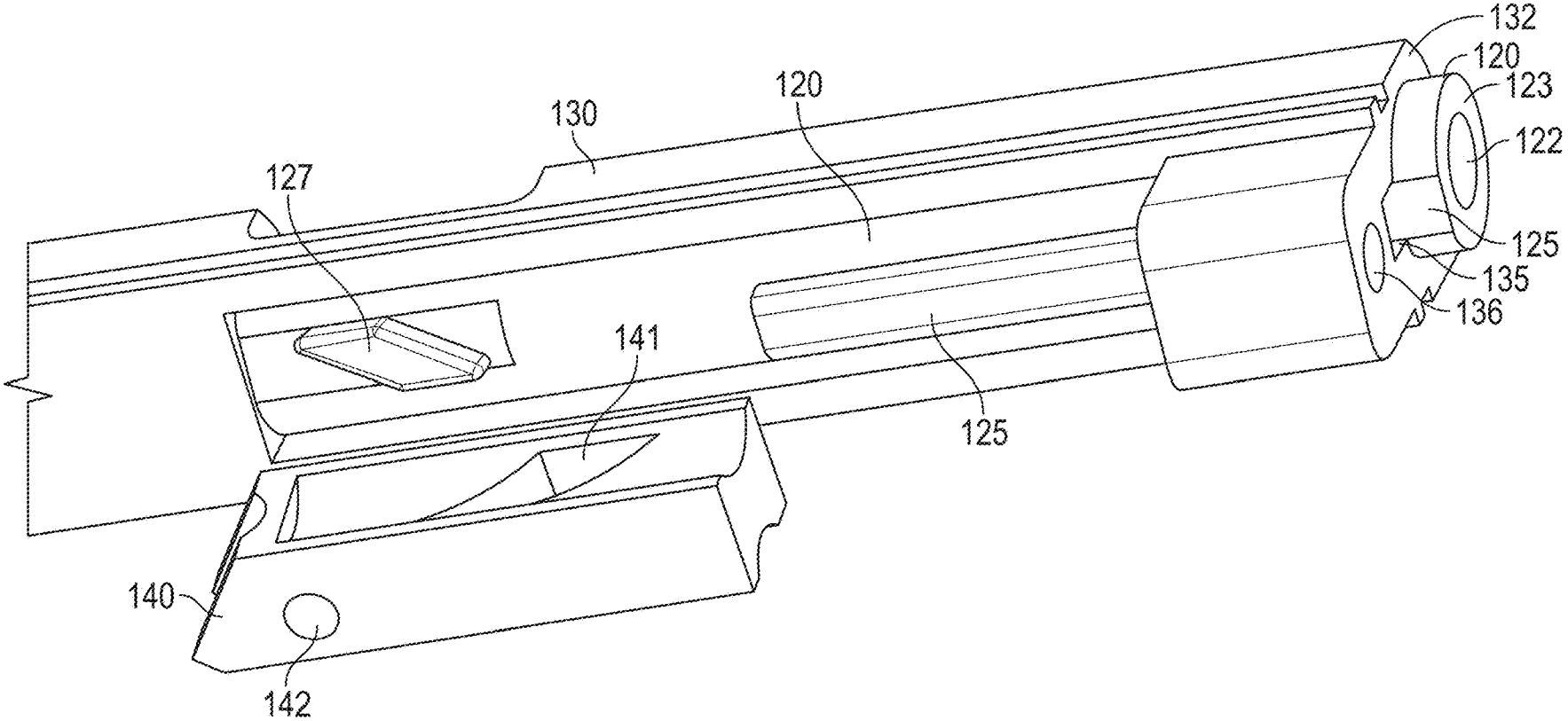
FIG. 5 is a bottom perspective view of one embodiment of the upper assembly of the invention.

FIG. 4 shows the upper assembly of firearm 100 in the full battery position. Barrel 120 is inserted into slide bore 131. Cam block 140 is attached to barrel 120 and configured such that cam lug 127 fits into cam slot 141. FIG. 5 shows an underside view of barrel 120 within slide 130 just before cam block 140 is removably attached to barrel 120 via cam lug 127.

As further shown in FIG. 4, recoil spring 160 enwraps guide rod 150, which is removably inserted into cam block 140 on one end and inserted into rod bore 136 on the other end. The free-floating upper assembly shown in FIG. 4 allows slide 130 to move rearward along the longitudinal axis of barrel 120 and guide rod 150 as rearward force is applied to slide 130, thereby compressing recoil spring 160. The upper assembly then returns to the full battery position upon release of slide 130 due to the opposite force supplied when recoil spring 160 expands to its resting position.

Figure 6:
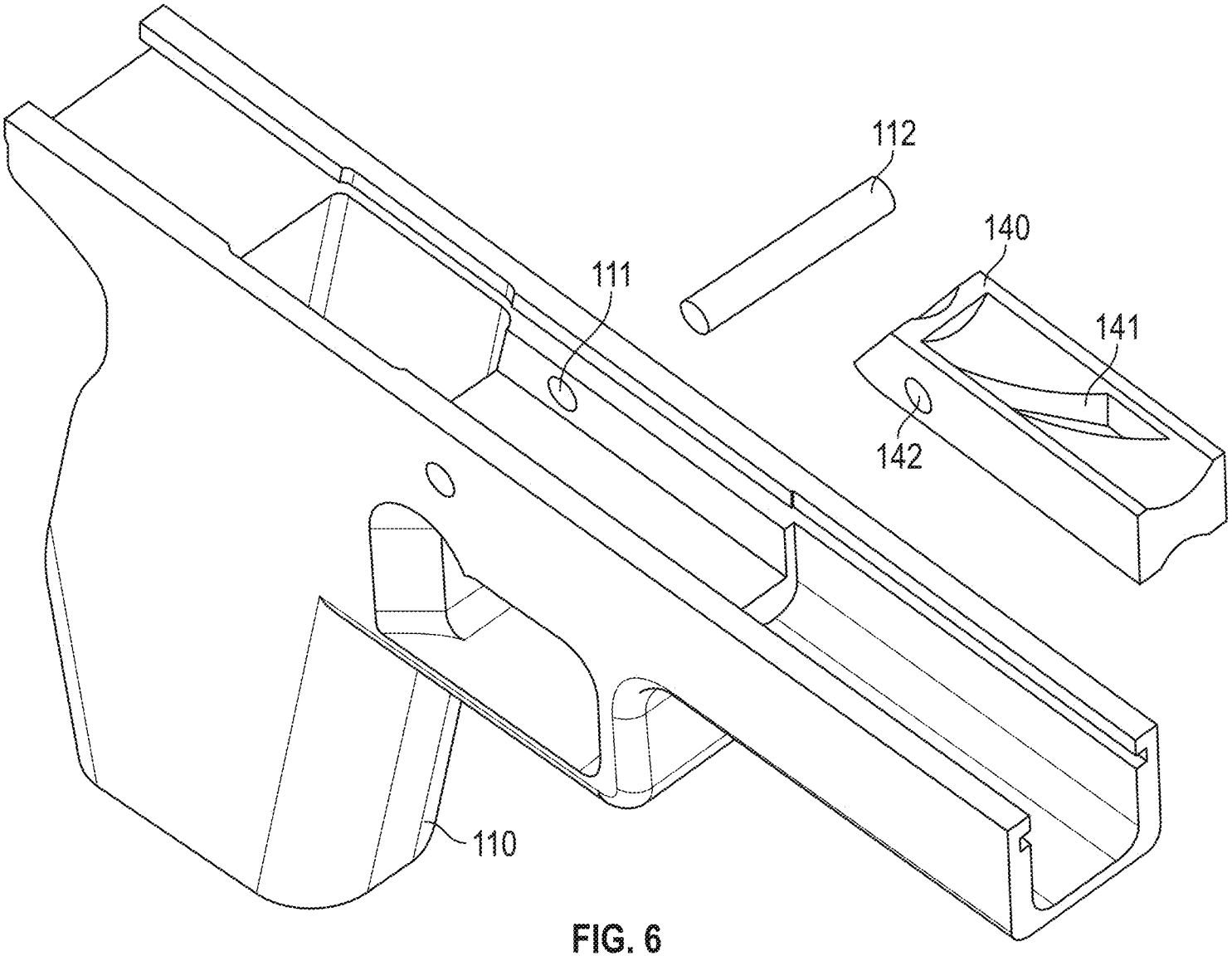
FIG. 6 is a perspective view of one embodiment of the frame of the invention.
Figure 7:
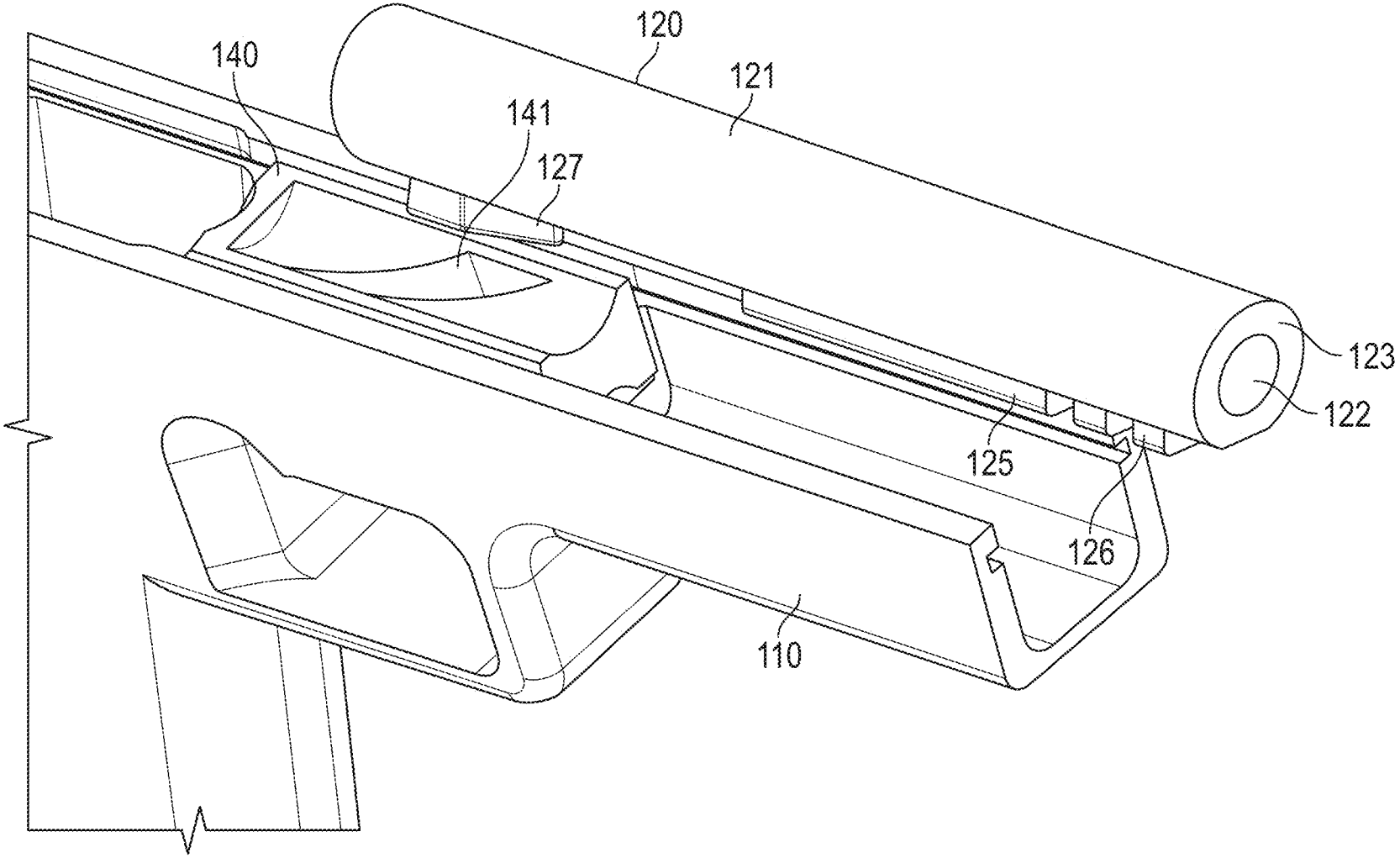
FIG. 7 is a perspective view of one embodiment of the frame of the invention and the barrel.

As shown in FIG. 6, cam block 140 (typically configured to barrel 120 as explained above) is placed into pistol frame 110 such that cross pin bore 142 lines up with cross pin holes 111. Cross pin 112 of suitable size is inserted through cross pin holes 111 and cross pin bore 142 to removably hold cam block 140 in place. FIG. 7 shows one view of cam lug 127 being inserted into cam slot 141 while cam block 140 is removably pinned to pistol frame 110.

Figure 8:
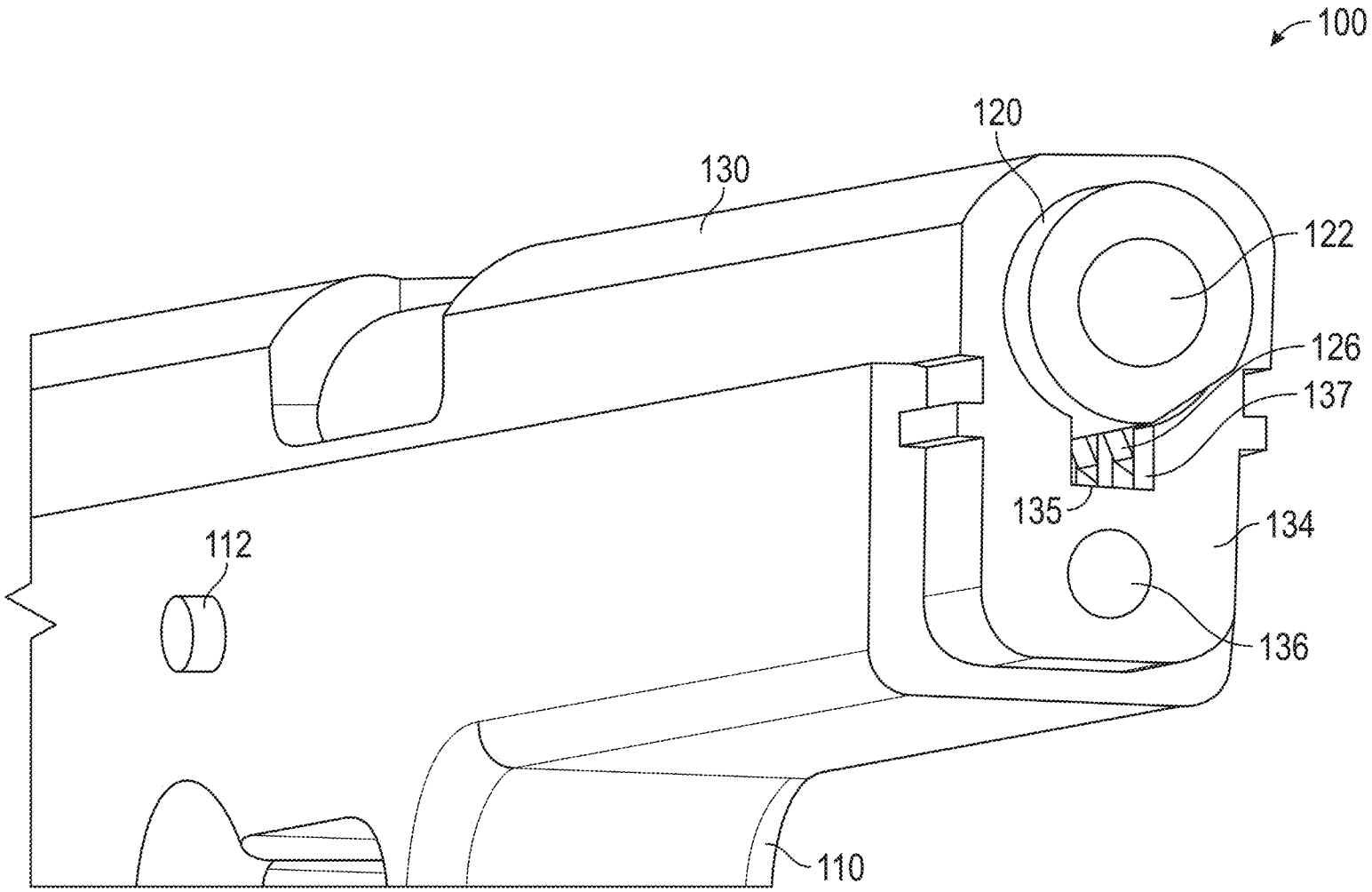
FIG. 8 is a perspective view of the discharge end of one embodiment of the invention in the full battery position.

FIG. 8 shows a close-up view of the discharge end of the upper assembly of firearm 100 in the full battery position. Note that barrel locking lug 126 is seated within slide locking slot 137. The configuration of cam lug 127 within cam slot 141 is such that in the full battery position, barrel 120 is rotated such that barrel locking lug 126 slides into slide locking slot 137, outside of the barrel chamber. Barrel chamber end 124 is fixed to the breech in such "locked" position as it is known in the industry. In one embodiment, barrel locking lug 126 keeps barrel 120 from separating from the breech while it is in the fully battery locked position. In another embodiment as described more fully below, control rail lug 125 and one or more barrel locking lugs 126 keep barrel 120 from separating from the breech while they are in their respective locked positions, as control rail lug 125 rests against extended lug boss rear face 138. Consequently, in each embodiment slide 130 and barrel 120 will initially slide rearward together when a cartridge is fired, and propellant gases force slide 130 and barrel 120 rearward.

Figure 9:
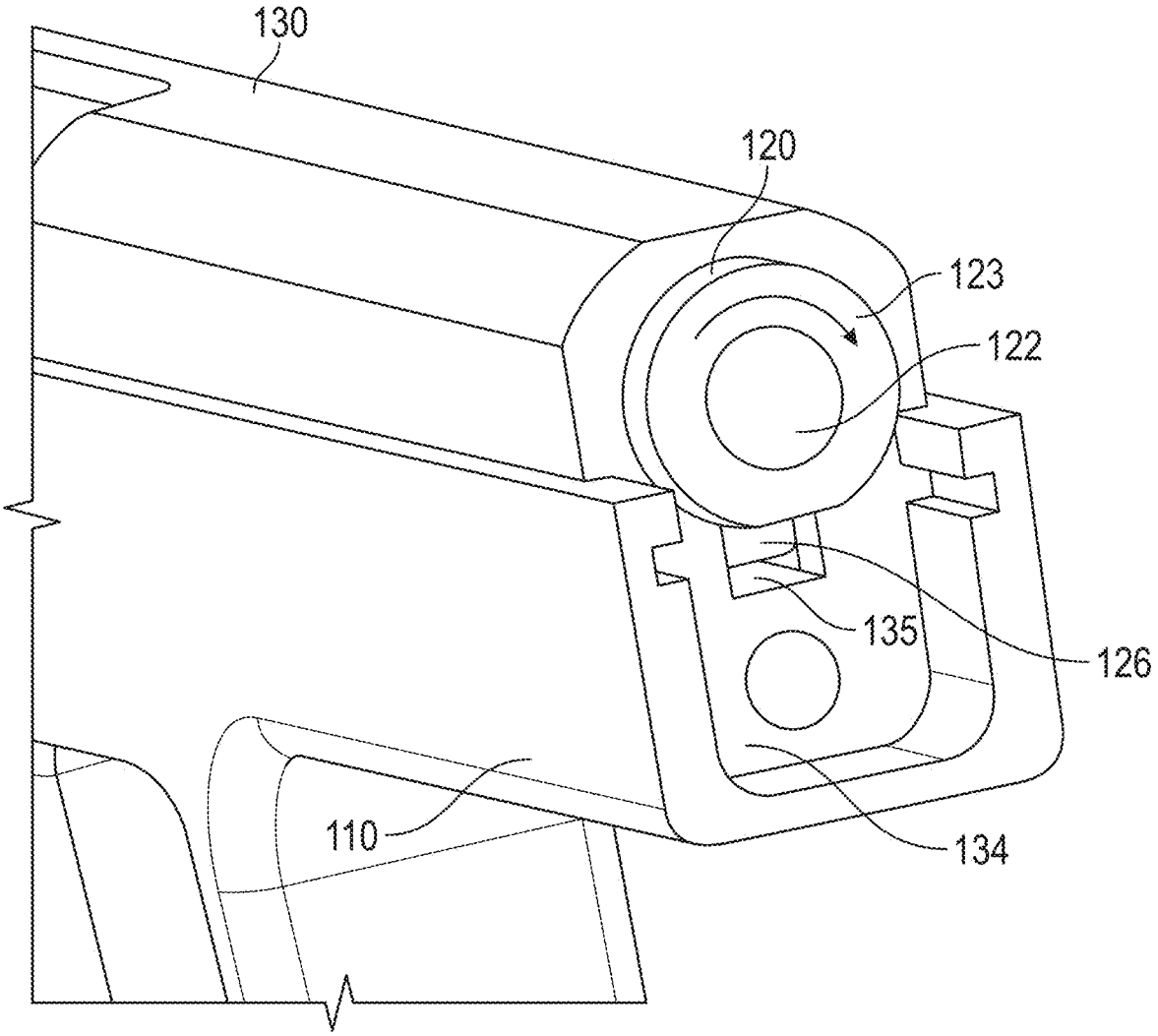
FIG. 9 is a perspective view of the discharge end of one embodiment of the invention immediately after the invention is fired.
Figure 10:
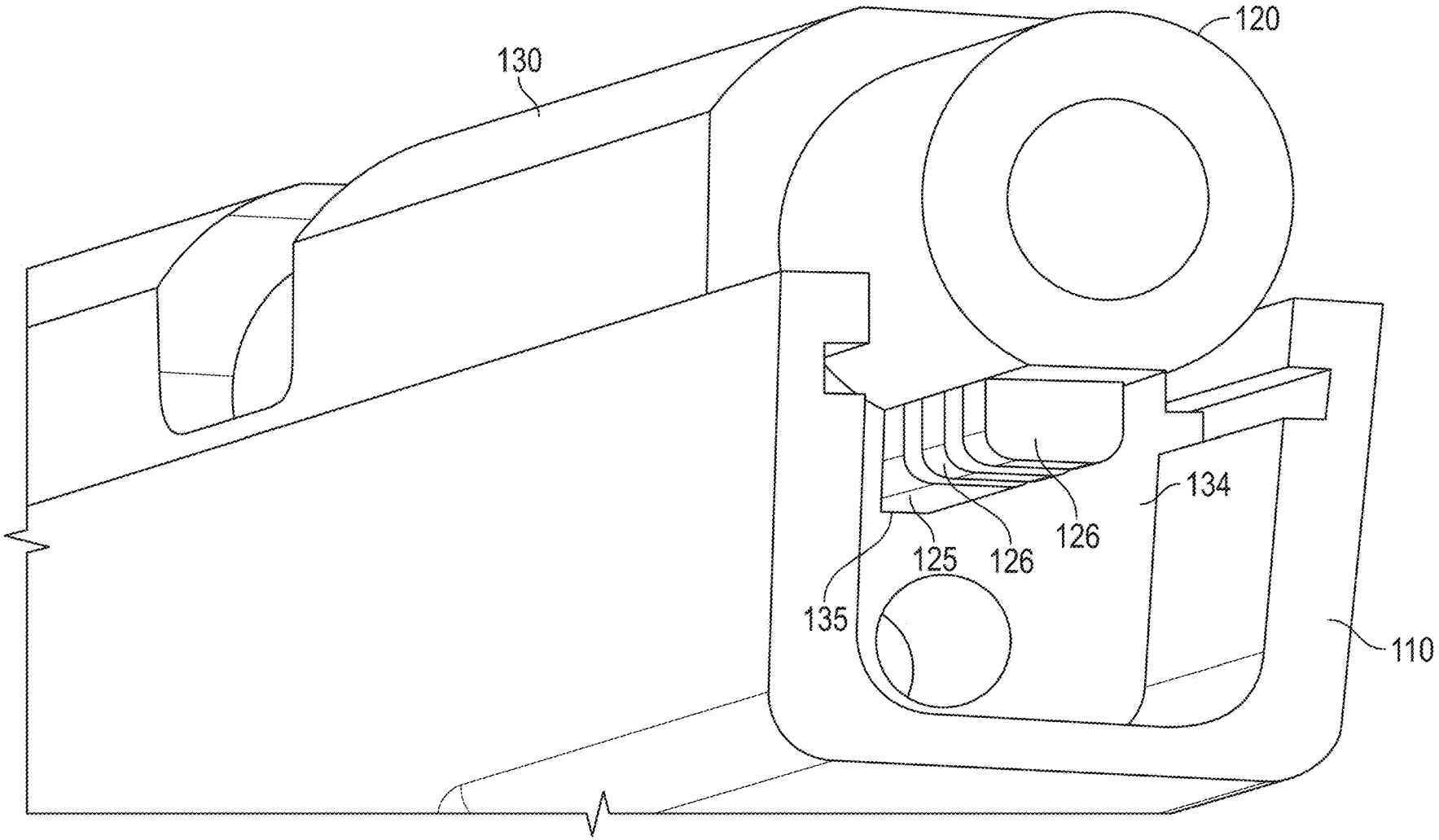
FIG. 10 is a perspective view of the discharge end of one embodiment of the upper assembly of the invention.
Figure 12:
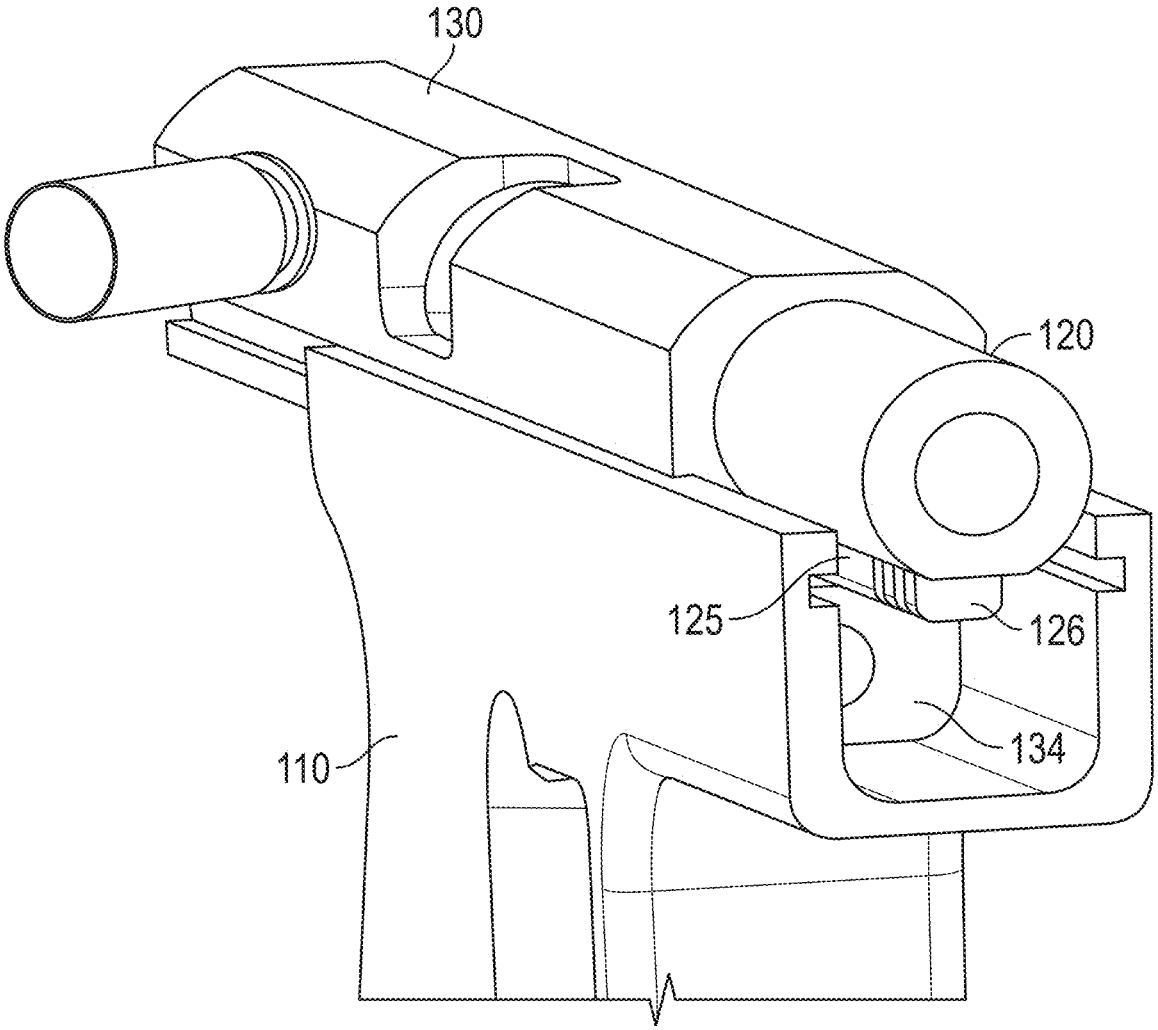
FIG. 12 is a perspective view of the discharge end of one embodiment of the invention out of battery.
Figure 13:
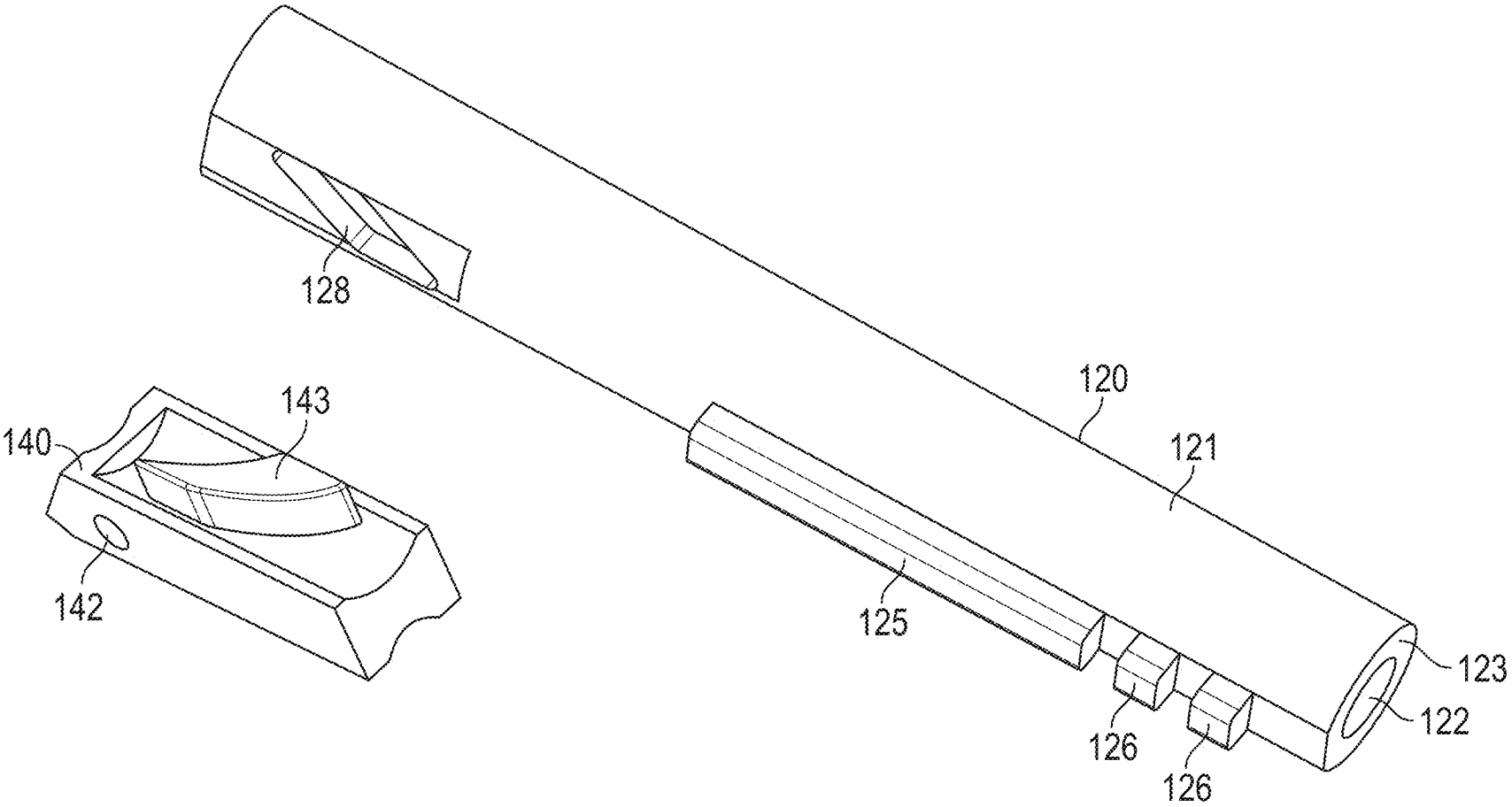
FIG. 13 is a perspective view of one embodiment of the barrel and the cam block of the invention.

The cam-and-lug configuration described in the foregoing embodiment operates to rotate barrel 120 as it initially moves rearward with slide 130. As shown in FIG. 9, barrel 120 rotates as it slides rearward due to the cam action, which operates to disengage barrel locking lug 126 from slide locking slot 137. Barrel locking lug 126 rotates into keyway slot 135. The rotation of barrel 120 also aligns control rail lug 125 with keyway slot 135 because control rail lug 125 and barrel locking lug 126 are axially aligned. As shown in FIG. 10 and FIG. 11, the alignment of control rail lug 125 and barrel locking lug 126 allows slide 130 to travel rearward along the longitudinal axis of barrel 120 while barrel 120 discontinues its rearward travel. As shown in FIG. 12, the cartridge case may be ejected from the chamber through the breech as slide 130 travels rearward. Recoil spring 160 then forces slide 130 back to the full battery position.

In another embodiment, barrel 120 may comprise more than one barrel locking lug 126. Naturally, slide 130 would have a sufficient number of slide locking slots 137 to accommodate each barrel locking lug 126.

In another embodiment, barrel 120 comprises at least one barrel locking lug 126 and control rail lug 125. Slide 130 comprises an equal number of slide locking slots 137 as barrel locking lug(s) 126. Control rail lug 125 does not rest against extended lug boss rear face 138 when firearm 100 is in the full battery position because barrel locking lug(s) 126 lock firearm 100 due to their displacement within slide locking slot(s) 137.

In yet another embodiment, barrel 120 may not comprise barrel locking lug 126. In such embodiment, control rail lug 125 is configured such that in the full battery position, it rests against extended lug boss rear face 138 which keeps barrel 120 and slide 130 locked. As a result, extended lug boss 134 exerts a rearward force on the discharge end of control rail lug 125 as slide 130 begins to move rearward. Control rail lug 125 would allow limited rearward travel of barrel 120 with slide 130 until control rail lug 125 aligns with keyway slot 135 due to the rotation of barrel 120 facilitated by the cam action discussed above. Barrel 120 would significantly slow or terminate reward travel when control rail lug 125 aligns with keyway slot 135, which would allow slide 130 to travel rearward along the longitudinal axis of barrel 120 as shown in FIG. 11 and FIG. 12.

In another embodiment, the cam-and-lug configuration may be reversed. Cam block 140 may comprise cam lug 143 instead of cam slot 141. Barrel 120 may comprise barrel cam slot 128 instead of barrel cam lug 127. Such configuration should be operable to rotate barrel 120 during rearward travel as explained above.

The configuration of the present invention allows for slide 130 to comprise less mass than prior art because control rail lug 125 and barrel cam lug 127 are aligned and not radially displaced around the external surface of barrel 120. The relatively smaller mass of slide 130 allows for barrel 120 to comprise more mass than prior art within the same overall size firearm. As a result, slide-to-barrel mass ratio is more balanced than prior art, which lowers the barrel bore axis, mitigates felt recoil and improves accuracy. Extended lug boss 134 facilitates the novel configuration by providing keyway slot 135, which allows for rearward travel of slide 130 along barrel 120.

Another benefit of the present invention is the barrel tunnel of slide 130 becomes a bearing journal. Current prior art calls for misaligned radial placement of locking lugs. Such misaligned radial placement, in turn, requires the barrel shaft to comprise slots at different radial positions, which eliminates the possibility of a bearing journal-to-shaft configuration. The current invention eliminates radially misaligned placement of the locking lugs, which is a novel design that reduces the mass of slide 130, thereby reducing the slide-to-barrel mass ratio and decreasing felt recoil.

In contrast, alignment of control rail lug 125 and barrel locking lug 126, configured to travel through keyway slot 135, allows for barrel 120 to become a bearing shaft with a smooth external surface. Barrel 120 may be sized, fitted, and mated to the barrel tunnel of slide 130, which then becomes a journal because the need for radially placed slots is eliminated as compared with prior art. In alternate embodiments, the tolerance between the barrel tunnel of slide 130 and external surface 121 of barrel 120 is between 0.0005 inches and 0.005 inches.

An appropriate weight of lubricant coating the exterior surface of barrel 120 will form a film which allows barrel 120 to float and center within the tunnel of slide 130. The seal created by the lubricant film and viscosity loss or shear as slide 130 moves rearward creates a hydraulic dampening effect and, therefore, promotes resistance to rearward travel of slide 130. In one embodiment, the lubricant may comprise an off-the-shelf automotive motor oil or gear oil with a winter weight ranging from 5 W to 75 W. Other lubricants known in the industry may also be used. As a result, felt recoil is reduced and accuracy is improved.

As with typical firearms, propellant gases from a fired cartridge force slide 130 rearward as they continue to expand. Barrel 120 initially slides rearward with slide 130 because they are locked, as extended lug boss rear face 138 exerts a rearward force on the discharge end of control rail lug 125 and barrel locking lug 126 rests within slide locking slot 137. Barrel cam lug 127 slides within cam slot 141 to facilitate rotation of barrel 120. As barrel 120 rotates, control rail lug 125 and barrel locking lug 126 align with keyway slot 135, thereby "unlocking" barrel 120 from slide 130 so that slide 130 may travel rearward down the longitudinal axis of barrel 120.

The propellant gases from the fired cartridge force the bullet toward discharge end 123 of barrel 120 while barrel 120 rotates. All components of barrel 120 and cam block 140 are configured such that by the time control rail lug 125 and barrel locking lug 126 (in one embodiment) are aligned with keyway slot 135, the bullet has exited barrel 120. Slide 130, being "unlocked" from barrel 120, freely travels down barrel 120 until the empty cartridge case is ejected. Recoil spring 160 then forces slide 130 forward, and firearm 100 is returned to the full battery position.

In another embodiment, barrel 120 does not comprise a barrel locking lug 126; rather, slide 130 "unlocks" from barrel 120 when control rail lug 125 aligns with and begins to travel down keyway slot 135.

What is claimed is:

1. A rotary-locking firearm comprising:

a frame;

a slide removably mounted to the frame and configured to move from a forward position to a rearward position along the axial length of a barrel, comprising a rear end and a discharge end, a barrel bore operable to receive a barrel, and an extended lug boss with a front face and a rear face disposed outside said barrel bore and at said discharge end;

wherein expanding propellant gases from a fired cartridge force said slide rearward, and wherein said extended lug boss comprises a keyway slot configured to guide the barrel after the firearm unlocks;

a rotary locking barrel comprising an external surface, an inner bore, a discharge end, a rear end, a control rail lug of defined length which rests against the rear face of said extended lug boss when the firearm is in the full battery position; and a cam assembly operable to facilitate the axial rotation and disengagement of said rotary locking barrel from said slide as the rotary locking barrel and slide move rearward under recoil from a fired cartridge.

2. The firearm of claim 1, wherein said cam assembly comprises a frame cam block and a barrel cam lug, said frame cam block operable to receive said barrel cam lug.

3. The firearm of claim 1, wherein said cam assembly comprises a frame cam block with a frame cam lug and a barrel cam slot, said barrel cam slot operable to receive said frame cam lug.

4. The firearm of claim 1, wherein said barrel further comprises a barrel locking lug proximal to the discharge end of said barrel, and said slide further comprises a slide locking slot within said extended lug boss, said slide locking slot operable to receive said barrel locking lug.

5. The firearm of claim 4, wherein said barrel locking lug is axially disposed in line with said control rail lug.

6. The firearm of claim 1, wherein said barrel further comprises at least one barrel locking luge proximal to the discharge end of said barrel, and said slide further comprises at least one slide locking slots within said extended lug boss, said at least one slide locking slots operable to receive said at least one barrel locking lugs.

7. The firearm of claim 6, wherein said barrel locking lugs are axially disposed in line with said control rail lug.

8. The firearm of claim 1, wherein the said defined length of said control rail lug is at least 0.25 inches and no longer than 4.0 inches.

9. The firearm of claim 8, wherein said barrel is coated with a hydraulic lubricant operable to create a hydraulic resistance dampening force in the direction of the discharge end of said barrel as said slide moves rearward.

10. A rotary-locking firearm comprising:

a frame;

a rotary-locking barrel comprising an external surface, an inner bore, a discharge end, a rear end, and a control rail lug of a defined length, wherein said barrel further comprises a barrel locking lug proximal to the discharge end of said barrel;

a spring-loaded mobile slide comprising a slide bore operable to receive said barrel, a rear end, a discharge end, and an extended lug boss disposed at said discharge end, wherein said slide is operable to move along the axial length of said barrel, and wherein said extended lug boss further comprises a slide locking slot proximal to the discharge end of said slide, said slide locking slot operable to receive said barrel locking lug, and wherein said extended lug boss further comprises a keyway slot operable to receive said control rail lug and said barrel locking lug, and wherein expanding propellant gases from a fired cartridge force said slide rearward along said barrel when said firearm is fired; and a cam assembly operable to facilitate axial barrel rotation as said slide and said barrel move rearward under recoil from a fired cartridge.

11. The firearm of claim 10, wherein said cam assembly comprises a frame cam block and a barrel cam lug, said frame cam block operable to receive said barrel cam lug.

12. The firearm of claim 10, wherein said cam assembly comprises a frame cam block with a frame cam lug and a barrel cam slot, said barrel cam slot operable to receive said frame cam lug.

13. The firearm of claim 10, wherein said barrel locking lug is axially disposed in line with said control rail lug and is operable to travel through said keyway slot when said slide moves rearward.

14. The firearm of claim 10, wherein said barrel further comprises two barrel locking lugs proximal to the discharge end of said barrel, and said extended lug boss further comprises two slide locking slots operable to receive said barrel locking lugs.

15. The firearm of claim 14, wherein said barrel locking lugs are axially disposed in line with said control rail lug.

16. The firearm of claim 10, wherein the said defined length of said control rail lug is at least 0.25 inches and no longer than 4.0 inches.

17. The firearm of claim 16, wherein said barrel is coated with a hydraulic lubricant operable to create a hydraulic resistance dampening force in the direction of the discharge end of said barrel as said slide moves rearward.

18. A method for delaying unlocking and buffering of recoil forces in an autoloading firearm, the method comprising the steps of:

providing a firearm with a receiver for chambering an ammunition cartridge, a trigger mechanism configured to ignite said ammunition cartridge, a barrel with a rear end and a discharge end, a control rail lug attached to said barrel, a barrel locking lug attached to said barrel and axially aligned with said control rail lug, a spring-loaded mobile slide operable to move along the axial length of said barrel, and a cam assembly operable to facilitate axial barrel rotation as said slide and said barrel move rearward under recoil from a fired cartridge, said slide further comprising an extended lug boss comprising a locking lug slot operable to receive said barrel locking lug, and said extended lug boss further comprising a keyway slot operable to receive said control rail lug and said barrel locking lug, and producing expanding propellant gases having a pressure within said cartridge chamber upon igniting said ammunition cartridge;

rotating said barrel to unlock said slide by aligning said control rail lug and said barrel locking lug with said keyway slot;

sliding said slide toward the rear end of said barrel; and opening a breech and discharging the ammunition cartridge casing.

* * * * *